United States Patent [19]

O'Brien

[11] Patent Number: 4,592,083

[45] Date of Patent: May 27, 1986

[54] HIGH SPEED X-RAY SHUTTER

[75] Inventor: Thomas P. O'Brien, Deerfield, Ill.

[73] Assignee: Tokyo Shibaura Denki Kabushiki Kaisha, Japan

[21] Appl. No.: 594,035

[22] Filed: Mar. 27, 1984

[51] Int. Cl.[4] ..... G21K 1/04

[52] U.S. Cl. ..... 378/160; 250/233; 250/498.1; 378/4

[58] Field of Search ..... 378/160, 158, 148, 157; 250/236, 233, 498.1; 251/134, 136; 350/269, 271, 275, 319

[56] References Cited

U.S. PATENT DOCUMENTS

| | | | |
|---|---|---|---|
| 3,021,751 | 2/1962 | Barnette | 350/269 |
| 3,119,019 | 1/1964 | Henry et al. | 378/160 |
| 3,124,689 | 3/1964 | Shure | 378/160 |
| 3,275,831 | 9/1966 | Martin . | |
| 3,384,751 | 5/1968 | Sperry . | |
| 4,029,963 | 6/1977 | Alvarez et al. . | |
| 4,071,771 | 1/1978 | Covic et al. . | |
| 4,143,273 | 3/1979 | Richey et al. | 378/160 |
| 4,277,685 | 7/1981 | Covic et al. . | |
| 4,370,631 | 1/1983 | Gerber et al. | 251/136 |
| 4,399,550 | 8/1983 | Hauck et al. | 378/157 |

*Primary Examiner*—Craig E. Church
*Assistant Examiner*—Charles F. Wieland
*Attorney, Agent, or Firm*—Finnegan, Henderson, Farabow, Garrett & Dunner

[57] ABSTRACT

A high speed actuator for controlling the shutter in x-ray equipment so as to eliminate transition time during which the x-ray dose is wasted. The actuator includes a driving solenoid for rotating and axially displacing a shutter member so as to move a shutter aperture to an open position, a mechanical arrangement for blocking movement of the member when the shutter aperture reaches the open position, and an electro-magnetic brake, having an armature and coil, interconnected with the driving solenoid such that braking engagement between the armature and coil is effected by movement of the shutter member and aperture to the open position.

11 Claims, 10 Drawing Figures

HIGH SPEED X-RAY SHUTTER

BACKGROUND OF THE INVENTION

This invention relates to shutter mechanisms and, more particularly, to high speed shutter mechanisms for controlling the emission of x-ray radiation in systems such as computer axial tomography scanners.

Most x-ray equipment utilizes a shutter, namely, a device for selectively blocking or passing an x-ray beam. In computer axial tomography scanning systems for medical diagnostic use, it is important to use a shutter which operates with a very short response time to minimize wasted x-ray dosage to the patient. Shutter response time is the time required for the shutter to be moved to a fully opened or fully closed position. Since useful data cannot be collected until the shutter is fully opened, the patient is subjected to some amount of extraneous, non-utilized x-ray dosage during transition of the shutter from the closed to the fully opened position.

SUMMARY OF THE INVENTION

Accordingly, it is an object of the present invention to provide an actuator for controlling a shutter mechanism with a very short response time.

It is a further object to provide an actuator for controlling a shutter having a relatively high mass, as is required with x-ray blocking devices.

A further object is to provide a high speed shutter actuator for an x-ray transmission system which is extremely simple in operation, reliable and capable of reproducing consistently repeatable shutter cycle times.

According to the present invention, a shutter actuator is provided, comprising: drive means for rotating a shutter member to move a shutter aperture to an open position; stop means for blocking movement of the shutter member when the shutter aperture reaches the open position; and magnetic braking means, including armature and coil means, interconnected with the drive means such that braking engagement between the armature and coil is effected by movement of the shutter member and aperture to the open position.

The accompanying drawings, which are incorporated in and constitute a part of this specification, illustrate a preferred embodiment of the invention and, together with the description, serve to explain the principles of the invention.

FIGS. *2a* and *2b* are elevational views of a shutter actuator mechanism in accordance with the invention, FIG. *2a* depicting the shutter in the closed position and FIG. *2b* depicting the shutter in the fully opened position;

FIG. *2c* is a cross-sectional view of the solenoid actuating mechanism taken along lines *2c—2c* of FIG. *2a;*

Figure 4:
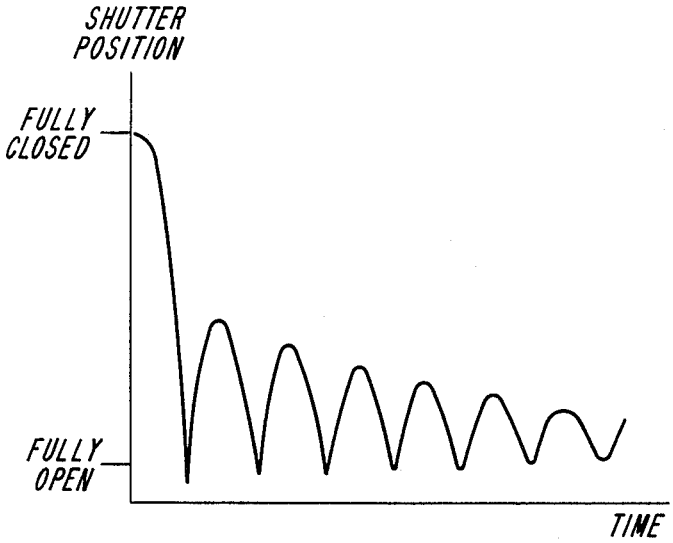
Figure 5:
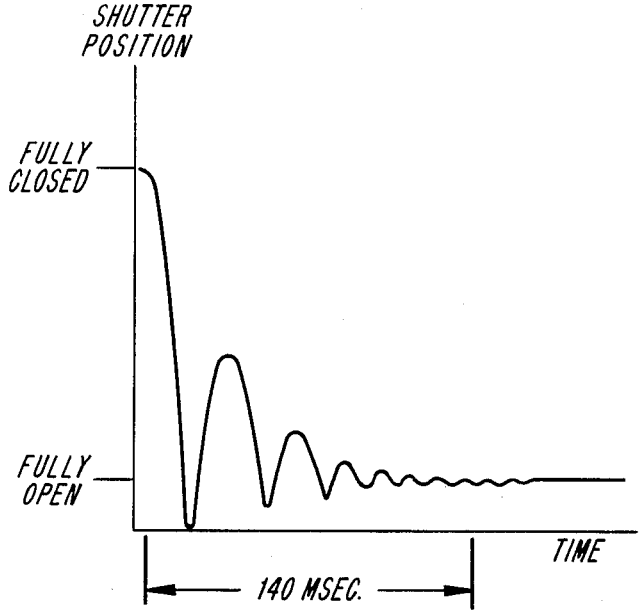
Figure 6:
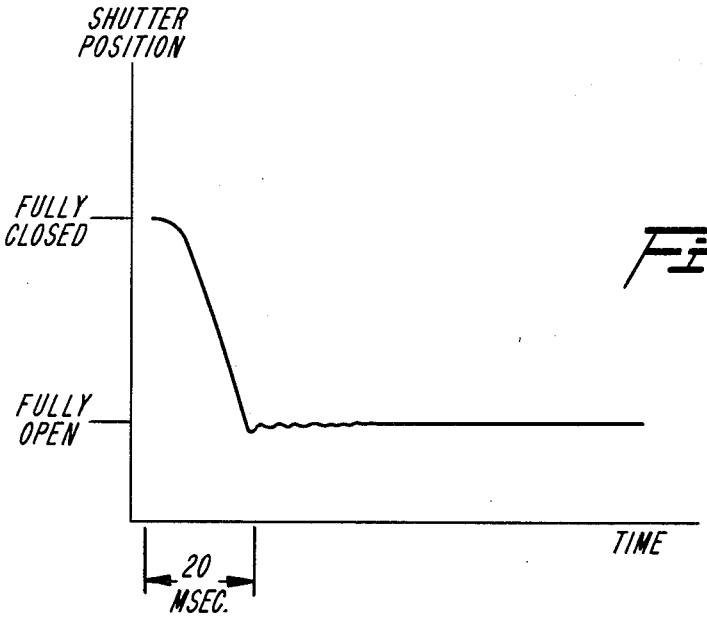

FIGS. *3a, 3b* and *3c* illustrate, in cross-section, the rotatable shutter rod of the present invention with the shutter aperture shown in several positions from fully opened (FIG. *3a*) to fully closed (FIG. *3c*);

FIG. 4 is a plot of shutter position against time illustrating the transition of the shutter mechanism from the fully closed to fully opened position without use of the resilient damping coupling and magnetic brake components of the invention;

FIG. 5 is a plot of shutter position against time showing the effect of introducing a resilient damping coupling without the magnetic braking means of the invention; and FIG. 6 is a plot of shutter position versus time illustrating the operation of the shutter actuating mechanism of the present invention.

DETAILED DESCRIPTION OF THE PREFERRED EMBODIMENT

Reference will now be made in detail to the presently preferred embodiment of the invention, examples of which are illustrated in the accompanying drawings.

Figure 1:
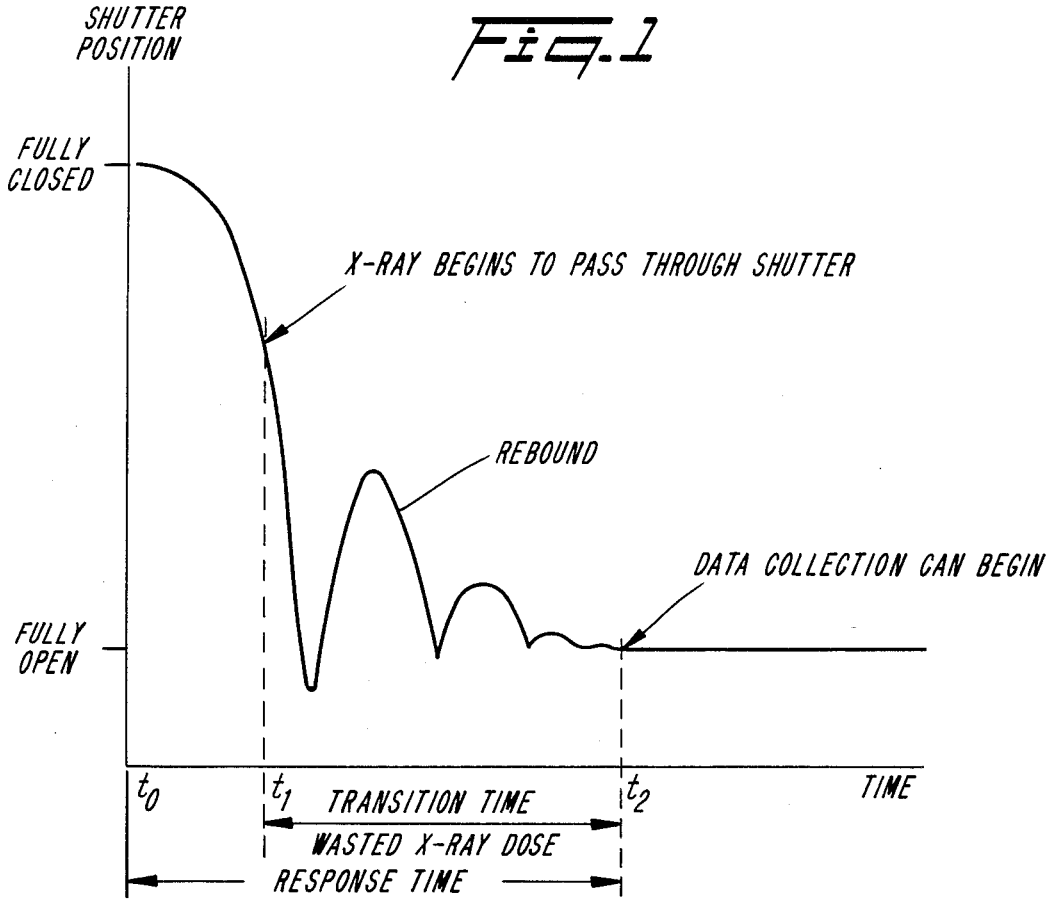
FIG. 1 is a plot of shutter position against time for a typical prior art shutter actuator device.

As shown in FIG. 1, a typical known shutter actuator mechanism experiences substantial rebound oscillations in being transferred from the fully closed to the fully opened position. Until the oscillations are dampened and the shutter reaches a stable opened condition, useful x-ray absorption data cannot be collected. During the transition time $t_1$-$t_2$, the patient is being exposed to extraneous, unutilizable x-radiation which needlessly increases the patient's exposure to radiation.

FIGS. *2a, 2b* and *2c* illustrate a preferred embodiment of a shutter actuator in accordance with the invention. A rotatable shutter member or rod 10, provided with a diametrically oriented x-ray transmission aperture 12, is mounted for rotational movement about its longitudinal axis.

An armature disc 16 of magnetic material is affixed, such as by means of a set screw or dowel pin (not shown), on a shaft 14 which is connected to the shutter rod 10. Shaft 14 extends through a fixed braking coil 18 which is mounted concentrically with respect to the shaft 14. A resilient coupling collar 22, 24 26, preferably formed of a rubber compound, connects the shaft 14 to a second shaft 15 which is coupled to a solenoid actuator 32.

Solenoid actuator 32 has a disc-like armature 28 coaxially connected to a central actuating shaft 15. A set of bearing balls 30 residing in corresponding ramped ball race camming slots (FIG. *2c*) convert the linear, i.e. axial, motion of the central actuator shaft 15 resulting from energization of solenoid actuator 32 into a sharp rotational movement of the armature 28, which is imparted to shaft 15 and, through collar 22, 24, 26, to the drive shaft 14. The torque thus produced is transmitted through resilient rubber damping coupling 22, 24, 26 to the shutter rod 10 and causes it to snap rapidly from the fully closed to the fully opened position. As shown in FIGS. *3a, 3b* and *3c,* this movement permits a beam of x-ray radiation B emitted by x-ray source S to pass through the shutter opening 12 and irradiate a target of interest. Shutter rod 10 is made of a high density material suitable for effective blocking of x-rays, such as tungsten, tantalum or lead.

A pulse generator 40 (FIG. *2a*) generates a voltage pulse which simultaneously activates the solenoid 32 and the braking coil 18. Pulse generator 40 preferably delivers a pulse having, initially, high current characteristics since this causes rapid acceleration of solenoid actuator 32 and concommitant rotation of shutter rod 10. Pulse generators suitable for such purposes are known in the art and need not be described herein to appreciate the present invention.

As the shutter rod reaches the fully opened position, solenoid armature 28 engages the solenoid actuator 32, as shown in FIG. *2b,* to arrest the movement of the rod 10 in the fully opened position. This engagement provides a stop means for blocking further movement of the shutter aperture past its fully opened position. Upon engagement of the solenoid actuator and armature, however, rod 10 typically rebounds substantially in the absence of resilient coupling 22, 24, 26. FIG. 4 illustrates the extreme oscillations produced when the shutter rod is arrested without use of the damping and braking devices 16, 18, 22, 24, 26 employed in the system of the invention. FIG. 5 depicts the somewhat lesser and more damped oscillatory condition produced upon the addition of the resilient coupling collar 22, 24, 26, but without the magnetic braking means 18 and 16.

Figure 2C:
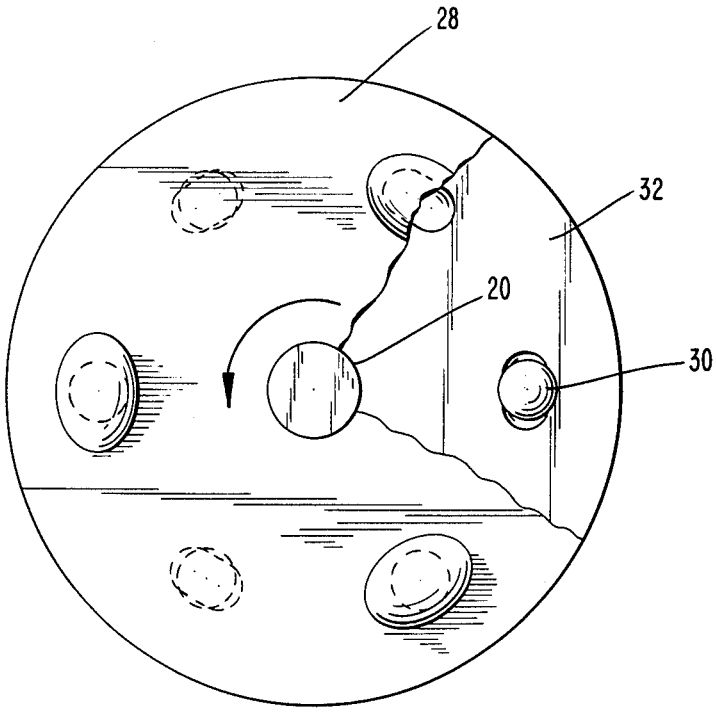
Figure 2A:
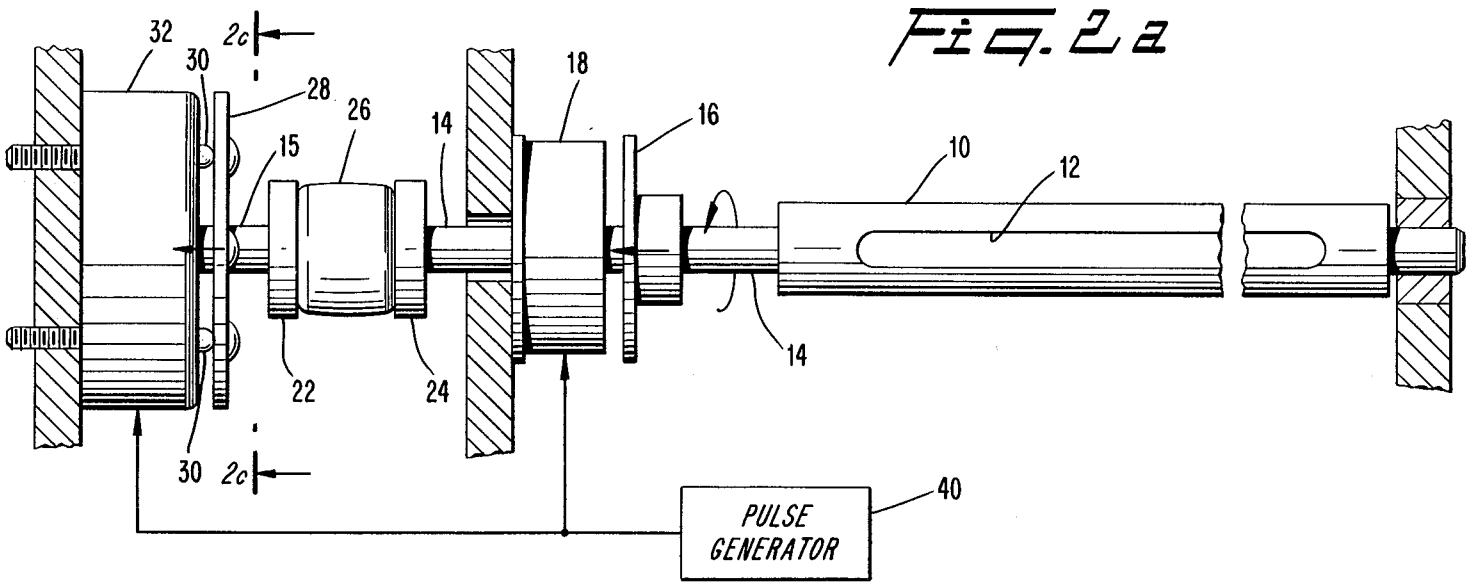
Figure 2B:
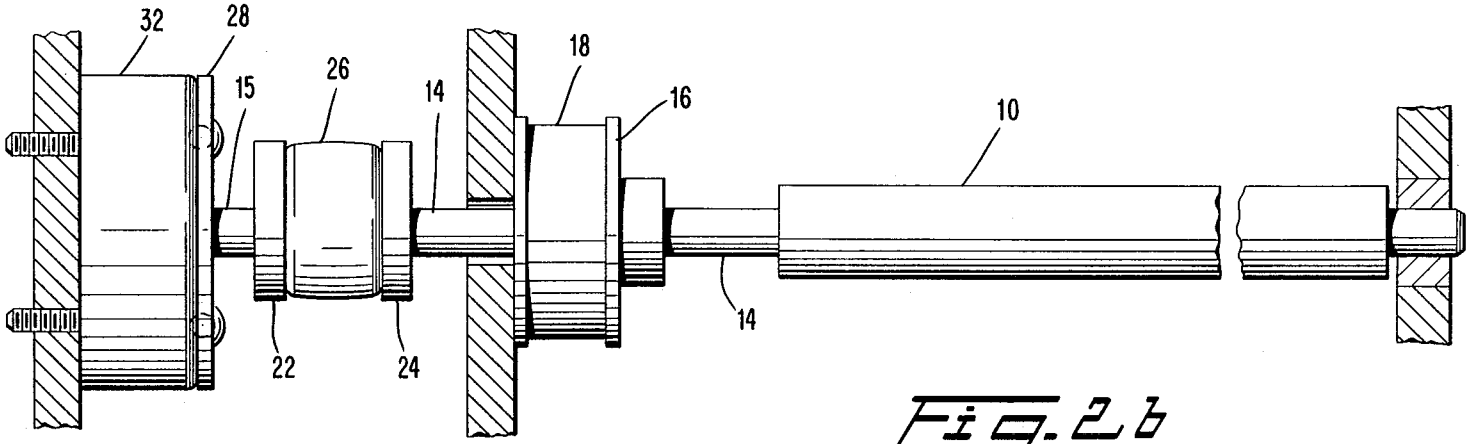
Figure 3A:
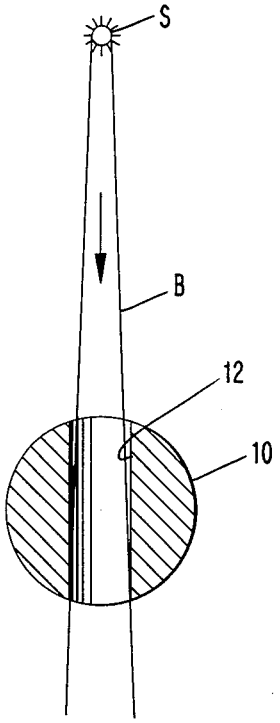
Figure 3B:
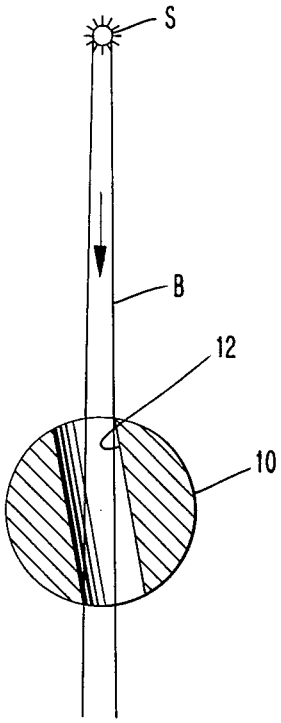
Figure 3C:
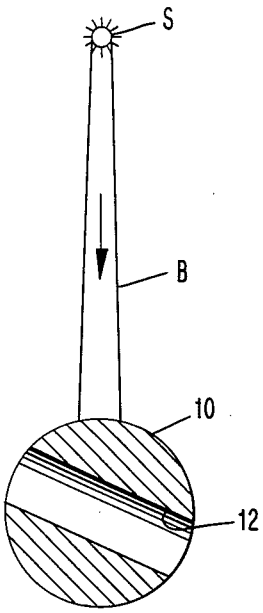

In accordance with the invention, energization of the drive solenoid 32 rotates the shutter rod 10 approximately 70° and at the same time displaces the rod and its associated shaft 14 along their longitudinal axis in the leftward direction, as shown in FIG. 2*b*. The air gap between coil 18 and armature disc 16 is set such that substantially the same extent of movement which is required to move the solenoid armature 28 into contact with the solenoid actuator 32 brings armature disc 16 into braking engagement with braking coil 18. That is, braking is effected by coil 18 and armature disc 16 as solenoid armature 28 comes into proximity with solenoid actuator 32.

The effect is to cause the shutter rod to be magnetically braked to a substantially reduced angular velocity immediately before it arrives at the fully opened position. This substantially eliminates rebound oscillations, as shown in FIG. 6. As the latter figure readily indicates, greatly improved shutter operation is achieved. The shutter rod proceeds from the fully closed to the fully opened position quickly and smoothly, and is arrested with virtually no oscillations whatsoever. This means that useful x-ray absorption data can be collected much sooner, resulting in reduced patient radiation exposure.

The actuator solenoid 32 may, for example, be a standard type of rotary solenoid such as is available from the "Shindengen Company," or any other type of rotary solenoid which is capable of simultaneous rotation and axial displacement movement. The electrical brake 16, 18 may also be a standard, commercially available unit, such as Model EC-11B-3 sold by the Electroid Company.

The shutter response can be readily adjusted for optimum operation by adjusting the position of armature disc 16 on shaft 14. Slight changes in the length of the air gap between coil 18 and armature 16 will alter the damping response of the shutter rod at the time it is brought to a stop.

As is apparent, the high speed shutter actuator of the present invention is simple in construction and operation and is capable of reliably reproducing consistent shutter operation, cycles for long periods of time.

It will be apparent to those skilled in the art that various modification and variations can be made in the preferred embodiment of the invention as described hereinabove without departing from the spirit and scope of the invention.

What is claimed is:

1. A shutter actuator in an X-ray scanner wherein a source of radiation rotates around an object while projecting radiation thereto, the radiation passing through the object being received by a detector, the actuator comprising:

drive means for rotating a shutter member to move a shutter aperture to an open position;

stop means for blocking movement of said member when said shutter aperture reaches said open position;

magnetic braking means, including armature and coil means, interconnected with said drive means such that braking engagement between said armature and coil is effected as said shutter member and aperture move to said open position; and resilient coupling means having an elastic member interposed between said drive means and said magnetic braking means to damp oscillatory energy produced by the blocking action of said stop means.

2. The shutter actuator of claim 1 wherein said drive means includes a solenoid and pulse generator means for energizing said solenoid, said pulse generator means also including means for energizing said braking coil.

3. The shutter actuator of claim 2 in which said pulse generator means simultaneously energizes said solenoid and said braking coil.

4. The shutter actuator of claim 1 wherein said armature and coil are arranged to effect said braking engagement immediately prior to the initiation of said blocking action of said stop means.

5. The shutter actuator of claim 1 in which said shutter member comprises a rotatable rod of x-ray absorptive material provided with a diametrically oriented aperture slot.

6. The shutter actuator of claim 5 in which said magnetic braking means includes a magnetic coil arranged concentrically about said rotatable rod and an armature disc mounted on said rod and spaced from said magnetic coil by an air gap.

7. The shutter actuator of claim 6 in which said drive means is constructed and arranged to rotate said rod for moving said aperture slot to said open position and for axially displacing said rod to effect braking engagement between said coil and said armature disc.

8. The shutter actuator of claim 7 wherein said air gap is dimensioned to produce said braking engagement just prior to the initiation of the blocking action of said stop means.

9. The shutter actuator of claim 6 wherein said air gap between said magnetic coil and said armature disk can be selectively adjusted.

10. A shutter actuator in an X-ray scanner wherein a source of radiation rotates around an object while projecting radiation thereto, the radiation passing through the object being received by a detector, the actuator comprising;

a rotatable shutter rod of x-ray absorptive material provided with a diametrically oriented aperture slot;

solenoid drive means for moving said shutter rod to place said slot in an x-ray transmitting open position, said drive means being arranged to both rotate and axially displace said rod;

stop means for blocking the movement of said rod when said aperture reaches the full open position;

resilient coupling means including an elastic member interposed between said solenoid drive means and said shutter rod to provide damping of oscillatory energy produced by the blocking action of said stop means;

magnetic braking coil means arranged concentrically about said shutter rod;

armature disc means mounted on said shutter rod and spaced from said coil means by an air gap; and pulse generating means for simultaneously energizing said solenoid drive means and said braking coil means to rotate said shutter rod to place said aperture slot in said open position and to draw said braking coil means and said armature disc means into braking engagement just prior to initiation of said blocking action of said stop means, and to arrest movement of said shutter rod substantially without rebound oscillations.

11. The shutter actuator of claim 10 wherein said air gap between and magnetic coil and said armature disk can be selectively adjusted.

* * * * *